US007261030B2

(12) United States Patent
Liberfarb et al.

(10) Patent No.: US 7,261,030 B2
(45) Date of Patent: Aug. 28, 2007

(54) METHOD AND SYSTEM FOR IMPROVING STABILITY OF HYDRAULIC SYSTEMS WITH LOAD SENSE

(75) Inventors: Zilek Liberfarb, Buffalo Grove, IL (US); Aleksandr Gershik, Vernon Hills, IL (US); Michael Cannestra, Kenosha, WI (US)

(73) Assignee: HydraForce, Inc., Lincolnshire, IL (US)

( * ) Notice: Subject to any disclaimer, the term of this patent is extended or adjusted under 35 U.S.C. 154(b) by 51 days.

(21) Appl. No.: 11/222,583

(22) Filed: Sep. 9, 2005

(65) Prior Publication Data

US 2006/0086244 A1 Apr. 27, 2006

Related U.S. Application Data

(60) Provisional application No. 60/608,504, filed on Sep. 9, 2004.

(51) Int. Cl.
*F15B 13/04* (2006.01)

(52) U.S. Cl. ..... 91/443; 60/461

(58) Field of Classification Search ..... 91/443; 60/459, 461, 462, 463, 466; 137/115.05, 137/501

See application file for complete search history.

(56) References Cited

U.S. PATENT DOCUMENTS 4,993,921 A * 2/1991 Taplin et al. ..... 60/452
5,048,561 A * 9/1991 Taplin et al. ..... 137/493.9
5,927,072 A 7/1999 Vannette
6,089,248 A * 7/2000 Rost ..... 60/452
6,260,467 B1 * 7/2001 Mickelson et al. ..... 91/443
6,966,329 B2 * 11/2005 Liberfarb ..... 137/115.05

OTHER PUBLICATIONS

Hydraforce, Inc., Lincolnshire, Illinois, catalog pages of pressure compensator EC42-M43, available prior to Sep. 9, 2005, pp. 5.516.1 and 5.516.2.

* cited by examiner

*Primary Examiner*—Igor Kershteyn
(74) *Attorney, Agent, or Firm*—Leydig, Voit & Mayer, Ltd.

(57) ABSTRACT

A hydraulic circuit is disclosed that can include a flow control element, a pressure compensator connected via a pair of load sense lines to an inlet line and an outlet line, respectively, of a flow control element to provide a constant pressure drop across the flow control element, and a load sense line control valve installed in a load sense line to provide controllable resistance in a flow passage in opposite flow directions, the resistance in each flow direction being different. The load sense line control valve can include a restrictive orifice followed by a spring-loaded check valve in a first flow direction and at least one other restrictive orifice and a check valve in a second flow direction, the second flow direction opposing the first flow direction.

12 Claims, 4 Drawing Sheets

METHOD AND SYSTEM FOR IMPROVING STABILITY OF HYDRAULIC SYSTEMS WITH LOAD SENSE

CROSS-REFERENCE TO RELATED PATENT APPLICATION

This patent application claims the benefit of priority to U.S. Provisional Application No. 60/608,504, filed Sep. 9, 2004, and entitled "Method of Improving Stability of Hydraulic Systems With Load Sense and Means for Utilizing Thereof," which is incorporated in its entirety herein by this reference.

FIELD OF THE INVENTION

The present invention relates generally to hydraulic valves and systems with load sense features and particularly to flow control systems with pressure compensators used to provide regulated flow independent of load or supply pressure.

BACKGROUND OF THE INVENTION

Hydraulic valves and systems are often used to transmit and control power through a fluid under pressure within an enclosed circuit. Power is usually controlled by maintaining an appropriate pressure and flow in a system or a part or component of the system. Load sense features are used in hydraulic systems to send information about actual load value to a control element. Usually the load sensing mechanism is simply a hydraulic line connecting a line before an actuator or a line with reference pressure level with a control device, like a pressure compensator. The latter is often used in flow control systems for achieving a high quality flow control.

A desirable flow rate may be constant or variable, and an appropriate flow control element may have a fixed or an adjustable opening for flow passage. In any case, flow through the control element depends not only on the size of the opening but also on the pressure drop across the opening. Special pressure compensators can be used to provide precise flow control regardless of the load or supply pressure. A pressure compensator is intended to provide a constant, relatively small pressure drop across a control element, for example, a fixed or adjustable orifice.

The main feature of a pressure compensator is a spool moveably disposed within a cage or a body. One side of the spool is connected to an input line of a control element; the opposite side is connected to an output line of the same control element. Another part of the compensator is a spring for pushing the spool in the direction of the side connected to the input line of the control element. In an equilibrium spool position, a force created by the input pressure acting on one side of the spool is equal to a force created by the outlet pressure acting on the other side of the spool in combination with a spring force. Any imbalance of the forces acting on the spool causes spool movement, which, in turn, changes the spool opening and adjusts the flow across the control element. Thus, the pressure differential across the control element, which is the spring force divided by the spool cross-sectional area, remains essentially the same regardless of the load or supply pressure, thereby making the flow through a control element essentially independent of load or supply pressure and being defined only by the opening of the control element.

System stability can be a desirable feature of a hydraulic system. Inasmuch as the opposite sides of a pressure compensator spool are connected to inlet and outlet lines of a control element, at least one of these lines is connected to a load and can be considered a load sense line. Flow in a load sense line is generally low as it is defined mainly by spool-body leakage and by spool displacement. One way to improve system stability is to provide a restrictive orifice in the load sense line for dampening spool movement. Though such an orifice improves stability, in some cases it makes the system sluggish in that the flow restriction causes an increased response time.

BRIEF SUMMARY OF THE INVENTION

The present invention provides a novel method of improving the stability of a hydraulic system having a load sense feature, a load sense line control (LSLC) valve, and a pressure compensator with a built-in load sense line control valve. The present invention provides a highly effective and versatile method of improving the hydraulic system stability substantially without sacrificing response time and offers means to utilize this method.

In some embodiments of the invention, a hydraulic circuit can include a flow control element, a pressure compensator connected via a pair of load sense lines to an inlet line and an outlet line, respectively, of a flow control element to provide a constant pressure drop across the flow control element, and a load sense line control valve installed in a load sense line to provide controllable resistance in a flow passage in opposite flow directions, the resistance in each flow direction being different. The load sense line control valve can include a restrictive orifice followed by a spring-loaded check valve in a first flow direction and at least one other restrictive orifice and a check valve in a second flow direction, the second flow direction opposing the first flow direction.

The LSLC valve can include a cage having an axial hole for inlet flow, at least one lateral cross hole for outlet flow, and a counterbore. A movable washer with a restrictive orifice can be disposed within the counterbore of the cage. An adaptor can be threadedly connected to the cage. A seat can be provided that is retentively disposed between the cage and the adaptor such that the seat is proximate to the movable washer to provide a sealing contact in at least one of positions of the washer. A ball can be disposed between the seat and the adaptor with a spring arranged to urge the ball into contact with the seat.

The washer can include a first restrictive orifice. The seat, ball, and spring can cooperate to act as a spring-loaded check valve. The seat can have at least one additional restrictive orifice providing a flow passage in parallel to the spring-loaded check valve and a surface contacting the movable washer in one of its positions to overlap the additional orifice.

The features of the present invention will become apparent to one of ordinary skill in the art upon reading the detailed description, in conjunction with the accompanying drawings, provided herein.

DETAILED DESCRIPTION OF THE INVENTION

In accordance with teachings of the present invention, there is provided a method of improving system stability and means for utilizing the same. Though the method and means for utilizing the same are shown in an example of a system used for pressure compensated flow control, it should be understood that the method and means for implementing it can be used and be effective in other hydraulic systems incorporating a load sense feature.

Figure 1:
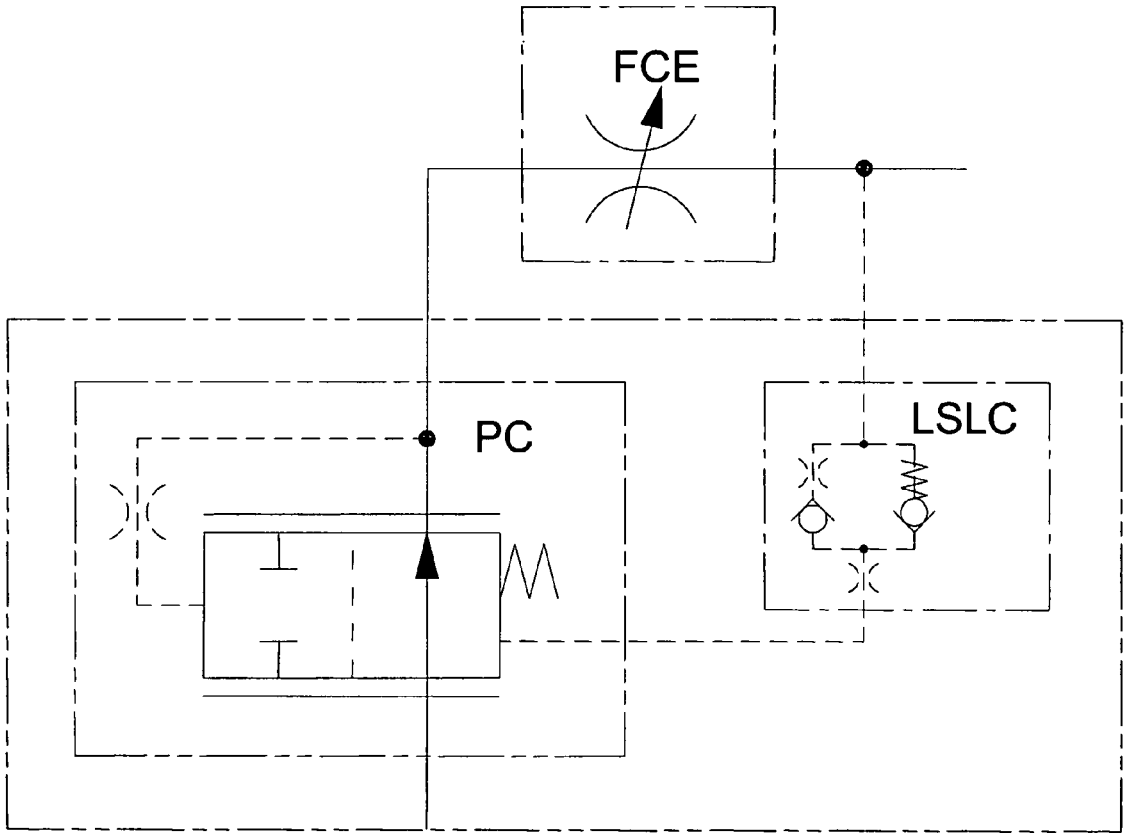
FIG. 1 is a diagram of an embodiment of a hydraulic circuit according to the present invention, including a pressure compensator (PC), a flow control element (FCE), and a load sense line control (LSLC) valve.

Referring to FIG. 1, the inventive hydraulic system can include a pressure compensator PC intended to provide a constant pressure drop across a flow control element FCE, the output line thereof being connected to the spring loaded side of a PC valve with a load sense line LSL. A LSLC valve is inserted in the LSL line. The LSLC valve contains a combination of fixed orifices and check valves allowing flow in opposite directions to and from the PC valve in a way that will be described later with reference to FIG. 2.

Figure 3:
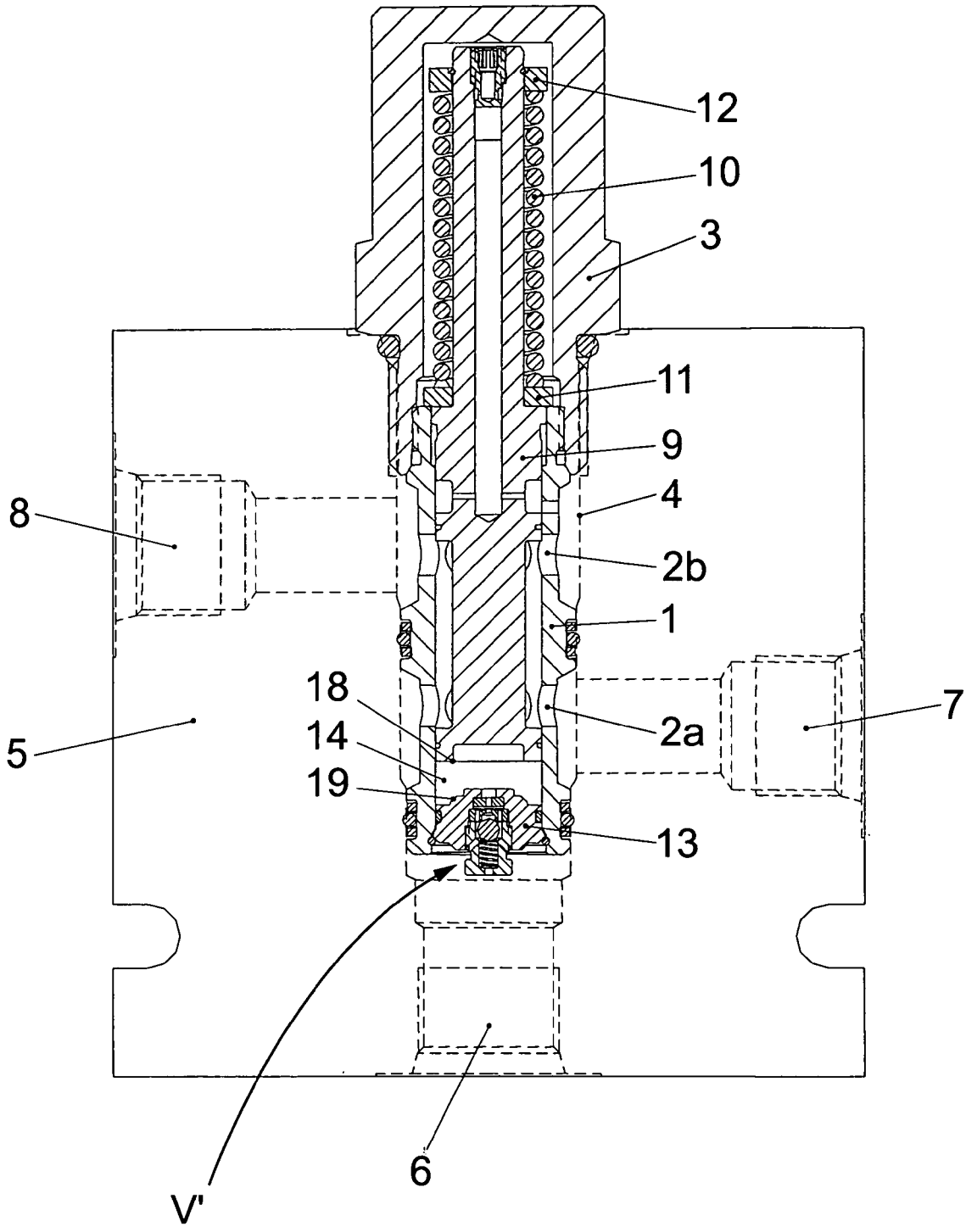
FIG. 3 is an elevational section view of another embodiment of a valve according to the present invention, in which a pressure compensator is combined together with an LSLC valve in a cartridge-type valve.

The PC and LSLC valves can be incorporated in two separate valves, which can be beneficial in cases where the inventive method and system are utilized as a modification of an existing application by adding the innovative LSLC valve. Both valves can be also incorporated in one valve, preferably a cartridge-type valve, as shown in FIG. 3.

Figure 2:
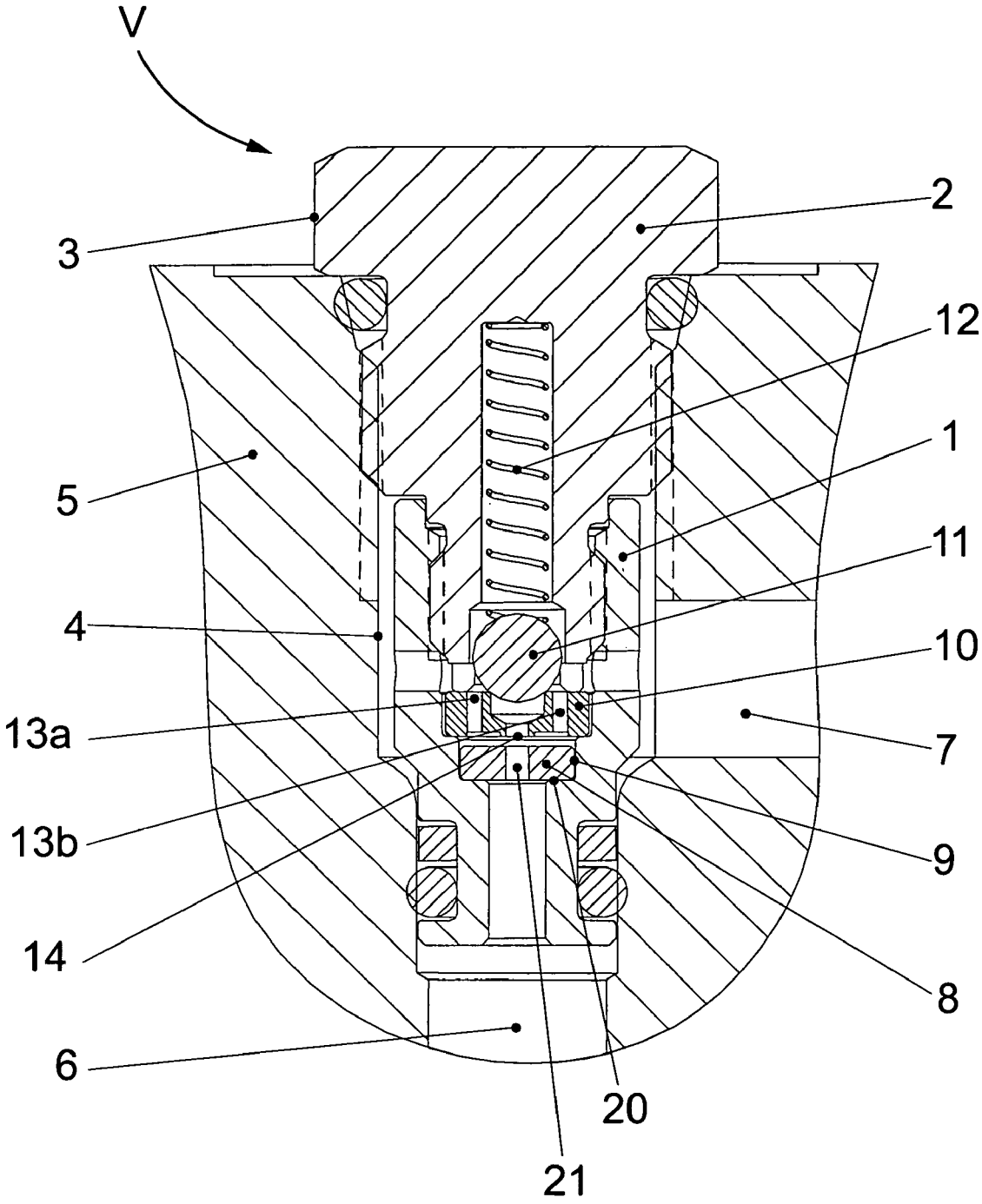
FIG. 2 is an elevational section view of an embodiment of a LSLC valve according to the present invention.

Referring to FIG. 2, an inventive flow control system can include a Load Sense Line Control (LSLC) valve V intended for installation in a load sense line. The LSLC valve V, shown in a preferable cartridge-type configuration, can be connected to a load sense port of a PC valve and to an outlet line of a FCE valve.

The LSLC valve V can include a cage 1 threadedly engaged with an adaptor 2 to provide, along with the outer seals, a cartridge 3 that can be installed into a cavity 4 of a body 5 to create two separated cavities connected to a first port 6 and a second port 7. An orifice washer 8 disposed within a counterbore 9 of the cage 1 is moveable in an axial direction. The LSLC valve V can include a seat 10 disposed between the cage 1 and the adaptor 2 and a ball 11 urged into engaging relationship with the seat via a spring 12.

When flow in the load sense line occurs in a direction from the first port 6 to the second port 7, the washer 8 is moved in response thereto toward the seat 10 to a displaced position. In this position, the washer 8 occludes side orifices 13*a*, 13*b* of the seat 10 and flow directed through a central orifice 14 of the seat 10 can overcome the spring force generated by the spring 12, thereby moving the ball 11 away from the seat 10 to allow flow to go from the first port 6 through the central orifice 14 of the seat 10 to the second port 7.

When flow moves in the opposite direction in the load sense line, the ball 11 remains seated on the seat 10 and flow goes through the side holes 13*a*, 13*b*, pushes the washer 8 against the cage shoulder and escapes though the washer orifice to the first port 6.

The above-described arrangement of the LSLC valve constitutes a restrictive orifice followed by a spring-loaded check valve in one flow direction and another restrictive orifice and a check valve in the opposite flow direction. This provides exceptional stability of the valve and hydraulic system while maintaining a fast response time as restrictive orifices can be of comparatively larger sizes.

The prevailing flow direction through the valve is from the first port 6 to the second port 7. This flow direction takes place in steady-state conditions and partially in transient conditions of the system. The opposite flow direction happens mainly in transient conditions when the compensator spool moves relatively fast in the direction opposite to the load sense port of a pressure compensator.

As the flow direction from the first port 6 to the second port 7 takes place most of the time, the spring-loaded check valve engaged in this flow direction can be used not only as a means to improve stability but also as a means to enhance the effective pressure differential created by the pressure compensator, thereby providing an effective and cost efficient way of increasing maximum pressure-compensated flow of a hydraulic system. The flow in the opposite direction does not require a pressure drop enhancement, as this is a make-up flow to fill the volume generated by the PC spool movement.

Referring to FIG. 3, an inventive flow control system can include a pressure compensator with a built-in load sense line control valve. The valve, shown in a preferred cartridge-type configuration, includes a cage 1 with two rows of lateral holes 2*a*, 2*b*. Threaded on one side of the cage 1 is an adaptor 3, which, along with the outside seals, form a cartridge that can be installed into a cavity 4 defined in a body 5 to create three separated cavities connected to the respective ports 6, 7, 8. An inlet line of the pressure compensator is connected to the second port 7, an outlet line thereof is connected to the third port 8 and a load sense line is connected to the first port 6. A spool 9 is movably disposed within the cage 1 and maintained in an initial position by a pre-loaded spring 10 located on the spool extension between a pair of washers 11, 12, movement of the spool away from the first port 6 is prevented by the adaptor 3, and spool movement toward the first port 6 is restricted by a pre-load force of the spring 10. An insert sub-assembly 13 is disposed within the cage 1 on a side opposite to the side where the adaptor 3 is located. The insert sub-assembly 13 includes a Load Sense Line Control valve V' similar to the one described in connection with the flow control system of FIG. 2. The hydraulic circuit of the valve is similar to the one shown and described above with reference to the flow control system of FIG. 1.

Referring again to FIG. 3, the second port 7 of the pressure compensator can be connected to a source of pressurized fluid, the third port 8 can be connected to an inlet of a flow control element, for example a needle valve, and the first port 6 can be connected to an outlet of the flow control element with a load sense line. The LSLC valve V' built into the insert 13 connects a cavity 14, formed between the spool 9 and the insert 13, to the first port 6, which is connected to the load sense line.

Figure 4:
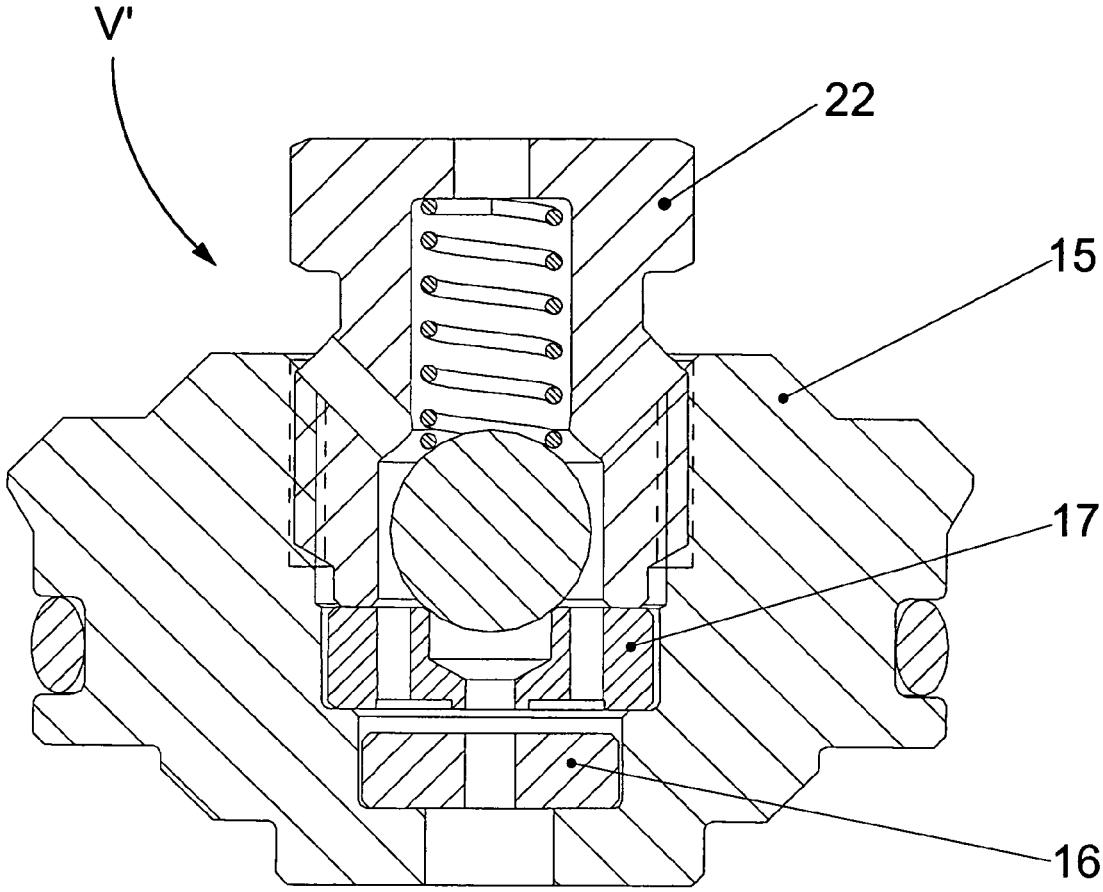
FIG. 4 is an enlarged view of the lower part of the valve shown on FIG. 3, which shows an LSLC valve built into a PC valve.

Referring to FIG. 4, the LSLC valve V' uses an insert 15 as a body. It includes also a movable orifice washer 16, a seat 17 disposed between the body 15 and a plug 20, the plug being threadedly engaged with the insert 15. The construction and operation of the valve are similar to the valve shown in FIGS. 1 and 2, described above.

The inventive pressure compensator shown in FIG. 3 has another feature especially useful in applications requiring a load-holding function. If, for example, the inlet port 7 is connected to a cylinder and used for a load lowering function, the lowering can be stopped at any time by closing the flow control element shown on circuit diagram as a needle. In this case, the spool 9 moves all the way down until it reaches the insert 13. The mating surfaces of the spool and the insert provide a leak-proof seal, for example, by arranging a sharp edged counterbore 18 at the bottom of the spool and a conical surface 19 at the top of the insert. This feature substantially prevents leakage into the load sense line and allows holding a load, for example a platform of a lift truck, in a desired position for a long time.

All references, including publications, patent applications, and patents, cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) are to be construed to cover both the singular and the plural, unless otherwise indicated herein or clearly contradicted by context. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Of course, variations of those preferred embodiments will become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. A hydraulic system having a load sense mechanism comprising: a hydraulic line connecting a load line to a control device for controlling pressure or flow in at least a part of the hydraulic system via a load sense line control device installed into a load sense line to provide controllable resistance to a flow passage in opposite flow directions, the load sense line control device having a spring loaded check valve to act in one flow direction and a non-loaded check valve to act in the opposite flow direction, the resistance in each flow direction being substantially different.

2. A hydraulic circuit comprising: a flow control element, a pressure compensator connected via a pair of load sense lines to an inlet line and an outlet line, respectively, of a flow control element to provide a constant pressure drop across the flow control element, and a load sense line control valve installed in a load sense line to provide controllable resistance in a flow passage in opposite flow directions, the load sense line control valve having a spring loaded check valve to act in one flow direction and a non-loaded check valve to act in the opposite flow direction, the resistance in each flow direction being substantially different.

3. A load sense line control valve comprising: a restrictive orifice followed by a spring-loaded check valve in a first flow direction and at least one restrictive orifice and a check valve in a second flow direction, the second flow direction opposing the first flow direction, wherein a first restrictive orifice is located in a moveable washer positioned in a counterbore of a body element followed by a seat of a spring-loaded check valve, the seat having at least one additional restrictive orifice providing a flow passage in parallel to the spring-loaded check valve and a surface contacting the movable washer in one of its positions to overlap the additional orifice.

4. A load sense line control valve comprising: a restrictive orifice followed by a spring-loaded check valve in a first flow direction; at least one restrictive orifice and a check valve in a second flow direction, the second flow direction opposing the first flow direction; a cage having an axial hole for inlet flow, at least one lateral cross hole for outlet flow, and a counterbore; a movable washer with a restrictive orifice, the washer disposed within the counterbore of the cage; an adaptor connected to the cage; a seat retentively disposed between the cage and the adaptor, the seat proximate to the movable washer to provide a sealing contact in at least one of positions of the washer; a ball disposed between the seat and the adaptor, and a spring arranged to urge the ball into contact with the seat.

5. The load sense line control valve according claim 4, further comprising a first seal mounted to the cage and a second seal mounted to the adaptor such that the cage, the adaptor and the seals are arranged in a cartridge type configuration for installation as a single unit into a cavity formed in a body.

6. A pressure compensator valve comprising: a cage with two rows of lateral holes, an adaptor threaded on one side to a cage, and a plurality of seals engaged with the adaptor and the cage to form a cartridge that can be installed into a cavity formed in a body to create three separated cavities connected to respective inlet, outlet and load sense ports, a spool slidingly disposed within an axial bore of the cage and maintained in an initial position by a pre-loaded spring, an insert sub-assembly installed into the cage on a side opposite to adaptor, the insert sub-assembly including a load sense line control valve comprising a restrictive orifice followed by a spring loaded check valve in a first flow direction and at least one other restrictive orifice and a check valve in a second flow direction, the second flow direction opposing the first flow direction.

7. The pressure compensator according to claim 6, wherein the load sense line control valve comprises a first restrictive orifice located in a moveable washer positioned in a counterbore of an insert body followed by a seat of a spring-loaded check valve, the seat having at least one additional restrictive orifice providing a flow passage in parallel to the spring-loaded check valve and a surface contacting the movable washer in one of its position to overlap the additional orifice.

8. The pressure compensator valve according to claim 7, wherein the mating surfaces of the spool and the insert provide a substantially leak-proof seal.

9. The pressure compensator valve according to claim 8, wherein the mating surface of the spool comprises a counterbore disposed at the bottom of the spool, and the mating surface of the insert comprises a conical surface at the top of the insert to substantially prevent leakage into the load sense line from the inlet line.

10. A hydraulic system having a load sense mechanism comprising: a hydraulic line connecting a load line to a control device for controlling pressure or flow in at least a part of the hydraulic system via a load sense line control device installed into a load sense line to provide controllable resistance to a flow passage in opposite flow directions, the load sense line control device including: a restrictive orifice followed by a spring-loaded check valve in a first flow direction and at least one restrictive orifice and a check valve in a second flow direction, the second flow direction opposing the first flow direction, wherein a first restrictive orifice is located in a moveable washer positioned in a counterbore of a body element followed by a seat of the spring-loaded check valve, the seat having at least one additional restrictive orifice providing a flow passage in parallel to the spring-loaded check valve and a surface contacting the movable washer in one of its positions to overlap the additional orifice.

11. A hydraulic circuit comprising a flow control element a pressure compensator connected with a pair of load sense lines to an inlet line and an outlet line, respectively, of a flow control element to provide a constant pressure drop across the flow control element, and a load sense line control valve installed in a load sense line to provide controllable resistance in a flow passage in opposite flow directions, the load sense line control valve having a moveable washer with a restrictive orifice and a spring-loaded check valve with a seat in a first flow direction, the spring-loaded check valve being downstream of the restrictive orifice relative to the first flow direction, and at least one restrictive orifice and a check valve in a second flow direction, the second flow direction opposing the first flow direction, wherein the moveable washer is disposed in a counterbore of a body element followed by the seat of the spring-loaded check valve, the seat having at least one additional restrictive orifice providing a flow passage in parallel to the spring-loaded check valve and a surface contacting the movable washer in one of its position to overlap the additional orifice.

12. A hydraulic circuit comprising a flow control element and a pressure compensator connected via a pair of load sense lines to an inlet line and an outlet line, respectively, of a flow control element the pressure compensator including a cage with two rows of lateral holes, an adaptor threaded on one side to the cage, and a plurality of seals engaged with the adaptor and the cage to form a cartridge that can be installed into a cavity formed in a body to create three separated cavities connected to respective inlet, outlet and load sense ports, a spool slidingly disposed within an axial bore of the cage, the spool maintained in an initial position by a pre-loaded spring, an insert sub-assembly installed into the cage on a side opposite to the adaptor, the insert subassembly including a load sense line control valve having a restrictive orifice followed by a spring-loaded check valve in a first flow direction and at least one restrictive orifice and a check valve in a second flow direction, the second flow direction opposing the first flow direction.

* * * * *

UNITED STATES PATENT AND TRADEMARK OFFICE

CERTIFICATE OF CORRECTION

PATENT NO. : 7,261,030 B2
APPLICATION NO. : 11/222583
DATED : August 28, 2007
INVENTOR(S) : Liberfarb et al.

It is certified that error appears in the above-identified patent and that said Letters Patent is hereby corrected as shown below:

IN THE CLAIMS:

Column 6, Line 30: "at least one of positions" should read -- at least one of the positions --.

Signed and Sealed this

Eighteenth Day of December, 2007

JON W. DUDAS
*Director of the United States Patent and Trademark Office*